US006859979B2

(12) United States Patent
Egger et al.

(10) Patent No.: US 6,859,979 B2
(45) Date of Patent: Mar. 1, 2005

(54) CABINET HARDWARE WITH BRAKING AND SHOCK ABSORBING DEVICE

(75) Inventors: Remo Egger, Bregenz (AT); Wolfgang Mueller, Lustenau (AT)

(73) Assignee: Grass GmbH, Hochst/Voralberg (AT)

( * ) Notice: Subject to any disclaimer, the term of this patent is extended or adjusted under 35 U.S.C. 154(b) by 0 days.

(21) Appl. No.: 10/388,684

(22) Filed: Mar. 14, 2003

(65) Prior Publication Data

US 2004/0103499 A1 Jun. 3, 2004

(30) Foreign Application Priority Data

Mar. 14, 2002 (DE) ..... 102 11 294

(51) Int. Cl.[7] ..... E05F 1/08; E05D 11/10

(52) U.S. Cl. ..... 16/327; 16/337; 16/335; 16/286

(58) Field of Search ..... 16/327, 337, 335, 16/336, 286, 341, 345, 352, 54, 50, 86 B

(56) References Cited

U.S. PATENT DOCUMENTS

| | | | | | |
|---|---|---|---|---|---|
| 4,184,228 | A | | 1/1980 | Lautenschlager et al. | |
| 4,359,803 | A | * | 11/1982 | Lautenschlager | 16/272 |
| 4,502,182 | A | * | 3/1985 | Lautenschlager et al. | 16/288 |
| 4,716,622 | A | * | 1/1988 | DeBruyn | 16/297 |
| 4,718,127 | A | * | 1/1988 | Rittmann et al. | 2/424 |
| 5,027,474 | A | * | 7/1991 | Bowers | 16/297 |
| 5,355,557 | A | * | 10/1994 | Cress et al. | 16/286 |
| 5,500,983 | A | * | 3/1996 | Lautenschlager | 16/304 |
| 5,604,956 | A | * | 2/1997 | Grass | 16/278 |
| 6,289,556 | B1 | * | 9/2001 | Salice | 16/335 |
| 6,401,298 | B1 | * | 6/2002 | Lenz | 16/335 |
| 6,553,625 | B2 | * | 4/2003 | Lin et al. | 16/342 |
| 6,725,502 | B2 | * | 4/2004 | Moll | 16/50 |

FOREIGN PATENT DOCUMENTS

| | | | | |
|---|---|---|---|---|
| AT | 349 931 | | 6/1979 | |
| DE | 2335000 | A * | 1/1975 | E05D/11/08 |
| DE | 2437494 | A * | 2/1976 | E05D/11/10 |
| DE | 3120201 | A * | 12/1982 | E05D/3/06 |
| DE | 3536711 | A * | 4/1987 | F24C/15/06 |
| DE | 4210438 | A1 * | 10/1993 | F16M/11/12 |
| DE | 197 17 937 | A1 | 5/1998 | |
| DE | 199 15 164 | A1 | 10/1999 | |
| JP | 10252740 | A * | 9/1998 | F16C/11/10 |

* cited by examiner

*Primary Examiner*—Chuck Y. Mah
(74) *Attorney, Agent, or Firm*—John M. Harrington; Kilpatrick Stockton LLP

(57) ABSTRACT

The invention concerns a cabinet fitting, in particular a hinge, with integrated braking and damping device, including a fastenable hinge arm on a cabinet component and a fastenable hinge cup on another movable cabinet component that is connected by at least one articulated lever with the hinge arm. The invention is characterized by the driver plate, which can slide, is held in the hinge cup and can be operated directly or indirectly by the articulated lever and has held in the hinge cup at least one pivoting or swiveling brake plate moves turning, so that the brake plate has at least one brake surface that glides on at least one corresponding, fixed brake surface or, on one opposite the first brake surface, a second movable brake surface.

14 Claims, 8 Drawing Sheets

FIG. 7
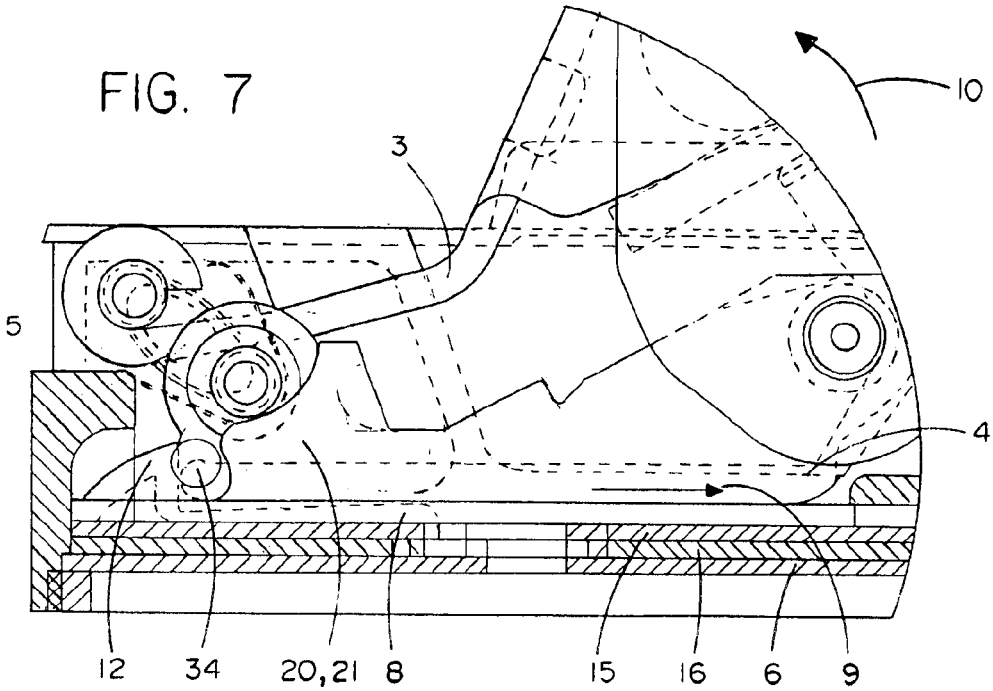
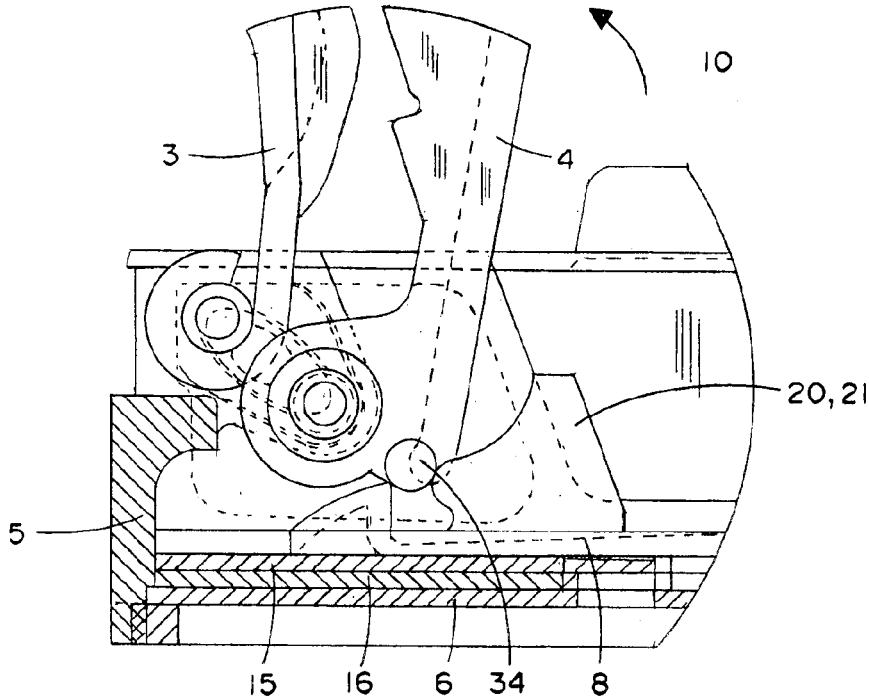
FIG. 8

CABINET HARDWARE WITH BRAKING AND SHOCK ABSORBING DEVICE

FIELD OF THE INVENTION

The invention concerns a cabinet fitting, in particular a cabinet hinge, with a braking and damping device.

BACKGROUND OF THE INVENTION

Damping and braking devices are well known in different variations in the present technology and are used in assorted areas of application. There are currently damping elements for movable cabinet parts in the form of simple buffers on the market. Such buffers are very well suited for moderating noise, but are, however, not suitable for diminishing the kinetic energy of the movable cabinet parts in the amount necessary. Another further development of a ductile buffer that is integrated in a hinge is described in DE-OS 27 08 545. Here, a flexible damping element is located between the hinge links of a cabinet hinge and deforms shortly before reaching the hinge's open position. A similar damping element for cabinet hinges is shown by AT-PS 349 931. Here, there is a flexible attenuator between the hinge arm and hinge cup on which the hinge arm is supported in a cushioned and absorptive manner.

Also, among other things, hydraulic or pneumatic dampers are well known, which have a piston-cylinder system with two working chambers, between which a liquid or gaseous medium flows and which then causes a braking or damping effect. Such dampers have a high static friction, due to the piston rod and piston sealing, which sets a reduction of the borders of the pump size. Furthermore, they are complex and expensive and are not suitable, therefore, as integrated dampers in cabinet fittings.

With cabinets and furniture, especially drawers and cabinet doors, braking and damping elements are likewise usually used in connection with spring elements. Braking elements of this type are made known in DE 199 15 164 A1 or DE 197 17 937 A1. These friction brake elements can, because of their high static friction, lead to the so-called 'Slip-Stick-Effect,' which becomes apparent by the rattling, sticking, etc. of the parts that are to be braked. Likewise, the wear and tear plays a large role with friction damping, especially if masses with high kinetic energy must be braked.

SUMMARY OF THE INVENTION

The task of the invention is to introduce a cabinet fitting, in particular a cabinet hinge with an integrated braking and damping device, which is able to brake and damp a moving cabinet component during its closing and opening process.

Furthermore, vibrations or impact noises are prevented during the closing process; that is, the movable cabinet component that can have varying mass and speed, should brake almost free from wear and tear over a certain distance (e.g. the closing angle).

According to the invention, a driver plate is held movable in the hinge cup, can be operated directly or indirectly by the articulated lever and shifts at least one brake plate held swiveling in the hinge cup, so that the brake plate has at least one braking surface that glides on at least one corresponding fixed or, opposite the first braking surface, on a movable second braking surface.

The core of the invention lies in the shifting of the linear adjusting movement of the driver plate to a rotating motion at least one, preferably circular brake plate. Thus, this results in a maximum braking surface, related to the hinge cup's dimensions that is formed by the brake plate's surface. Preferably, the outside dimension of the brake plate corresponds essentially to the inside diameter of the hinge cup.

Furthermore, depending on the type of movement transfer between the driver plate and brake plate, a considerably larger "braking distance" can be attained in comparison to the linear movement distance, which is defined by the rotation angle of the brake plate. Further, the relative velocity of the brake plate is greater in comparison to the speed of the driver plate, which, likewise, affects the attainable braking action positively.

The driver plate is located, preferably, closed to the base area of the hinge cup and is guided there linearly by a guide groove.

The hinge cup is locked by a base plate, whose inner surface forms the fixed braking area on which the brake plate rests.

Preferably, at least one brake plate is held swiveling on the base plate and is located between the base plate and the driver plate.

In a preferred embodiment of the invention, the driver plate has at least one driver pin, which engages in a driver opening (eccentric to the rotation axle) of the brake plate. In this way the linear movement of the driver plate is converted into a rotating motion of the brake plate around its rotation axle. The speed ratio is determined by the distance of the driver pin from the rotation axle of the brake plate.

In another preferred embodiment of the invention, a second brake plate is held swiveling in a hinge cup so that the movable brake surface is formed by the second brake plate. In this embodiment, both brake plates lay one on the other. The driver plate has here a second driver pin that engages in a driver opening of the second brake plate; whereby, the driver pin of the driver plate and the corresponding driver openings of both brake plates are arranged in such a manner around the rotation axle of the brake plates so that a movement of the driver plate shifts the two brake plates into rotation movements in opposite directions.

The use of two or more brake plates can increase the obtainable braking force substantially. Moving in opposite directions can double the speed of the brake plates relative to one another and can, thereby, also double the relative "braking distance."

Preferably, the manipulation of the driver plate by the articulated lever occurs only in the area of the cabinet fitting's defined closing angle. Thus, the effective range of the braking and damping device adapts to the respective conditions.

The driver plate is preferably operated by two separated, one-side loaded contact surfaces by the articulated lever. When the cabinet hinge is closed, the edge of the articulated lever meets a driver nose of the driver plate and so shifts the driver plate linear for a short distance. At the same time the brake plates are shifted turning. When the cabinet hinge is opened, two latches that are on the driver plate are carried forward by release pins that are on the articulated lever. Thus, the driver plate and the brake plates are shifted again into its initial "exit" position.

In another embodiment of the invention, the outside diameter of the brake plate is selected substantially smaller than the inside diameter of the hinge cup. The brake plate is surrounded by a brake gear rim and partly provided by external teeth, which comb with the inner teeth of the brake gear rim that sets the brake gear rim in rotation.

In a favorable way, an increase in the "braking force" is attained because the surfaces of at least one brake gear rim form additional movable brake surfaces.

It can be provided with all embodiments that a highly viscous liquid medium is brought in between the fixed and movable brake surfaces, so that the highly viscous medium exposes its inner molecular friction by its adhesion to the surfaces and the kinetic energy of the mass to be intercepted is converted into friction heat.

Compared with known braking and damping devices of cabinet fittings, the invention offers substantial advantages.

It can be defined whether the damping and braking actions are to work over the entire closing area or only in a certain closing angle. Furthermore, the design of the cabinet fitting is very compact because no external damping elements are needed. The braking and damping device is integrated in the hinge and is not visible externally. Altogether, the cabinet hinge remains unchanged externally; that is, no change is necessary in the design. The size, likewise, remains the same. Furthermore, the adjustment possibilities (for example, side and vertical adjustments) are invariably present. Also, the installation on the cabinet stays the same.

A further advantage is the suggested braking and damping elements are quite inexpensive to produce and can be integrated into the cabinet fitting.

In the following, the invention is more closely described based on several embodiment examples with reference to the design figures. Further characteristics, features, advantages and application possibilities are shown in the drawings and the descriptions.

BRIEF DESCRIPTION OF THE DRAWINGS

FIG. 7: a detailed view of the driver plate's operation by the articulated lever when the hinge is closed;

FIG. 8: a detailed view of the driver plate's operation by the articulated lever when the hinge is being opened;

DETAILED DESCRIPTION

Figure 1:
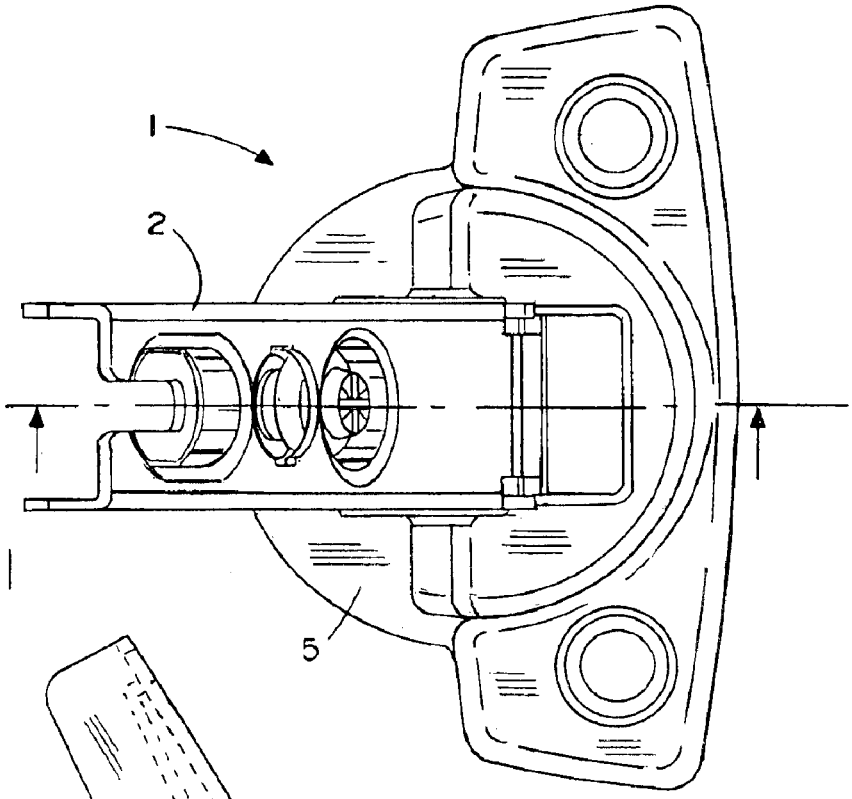
FIG. 1: an overview of the cabinet hinge, according to the invention, in a first embodiment.
Figure 2:
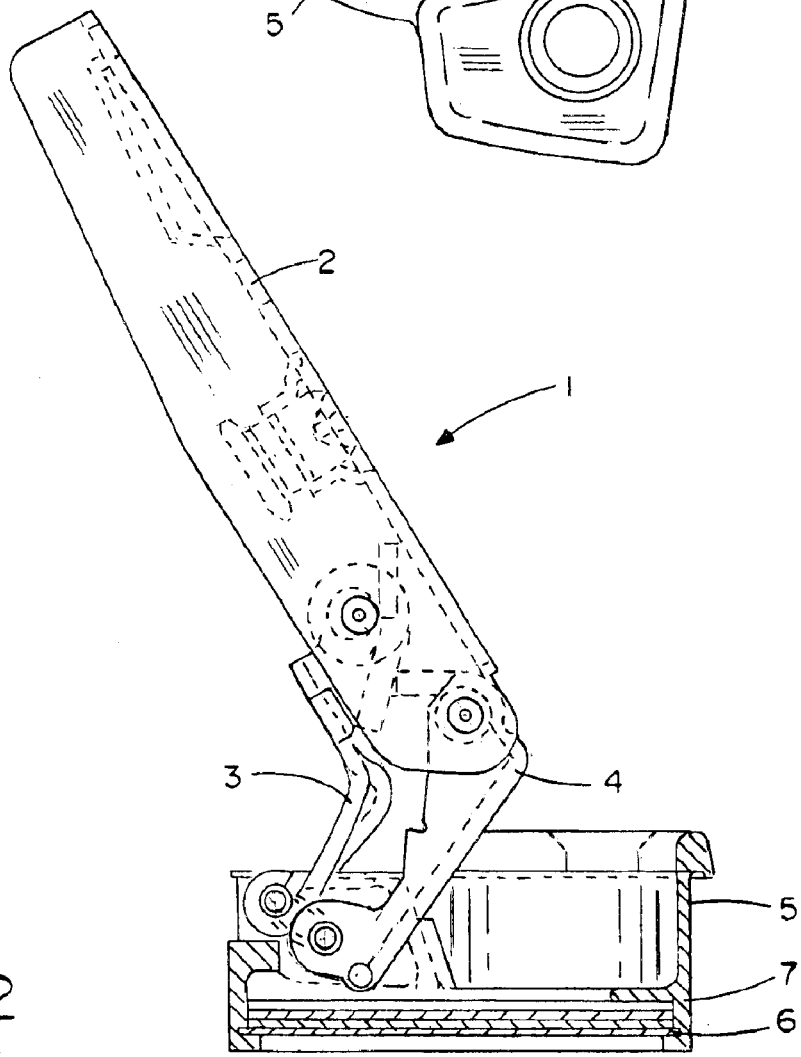
FIG. 2: a side section cut through the cabinet hinge, according to FIG. 1, in a half-closed position.

FIGS. 1 and 2 show a cabinet hinge (1), by means of which a cabinet component (for example, a cabinet door), can be fastened movable to a cabinet body. The cabinet door can be opened, thereby, within the range of an opening angle, so that closes, within the range of a closing angle, automatically by the cabinet hinge (1). This automatic closing movement applies to the braking and damping, since the cabinet door would, otherwise, impact hard on the cabinet body.

The cabinet hinge (1) includes a hinge arm (2) that is fastened to the cabinet door and that is connected swiveling by an outer and an inner articulated lever (3, 4) with a hinge cup (5). The hinge cup is locked by a base plate (6) and contains the invention-related braking and damping device (7), which produces the necessary braking action when the cabinet hinge is closed.

Figure 3:
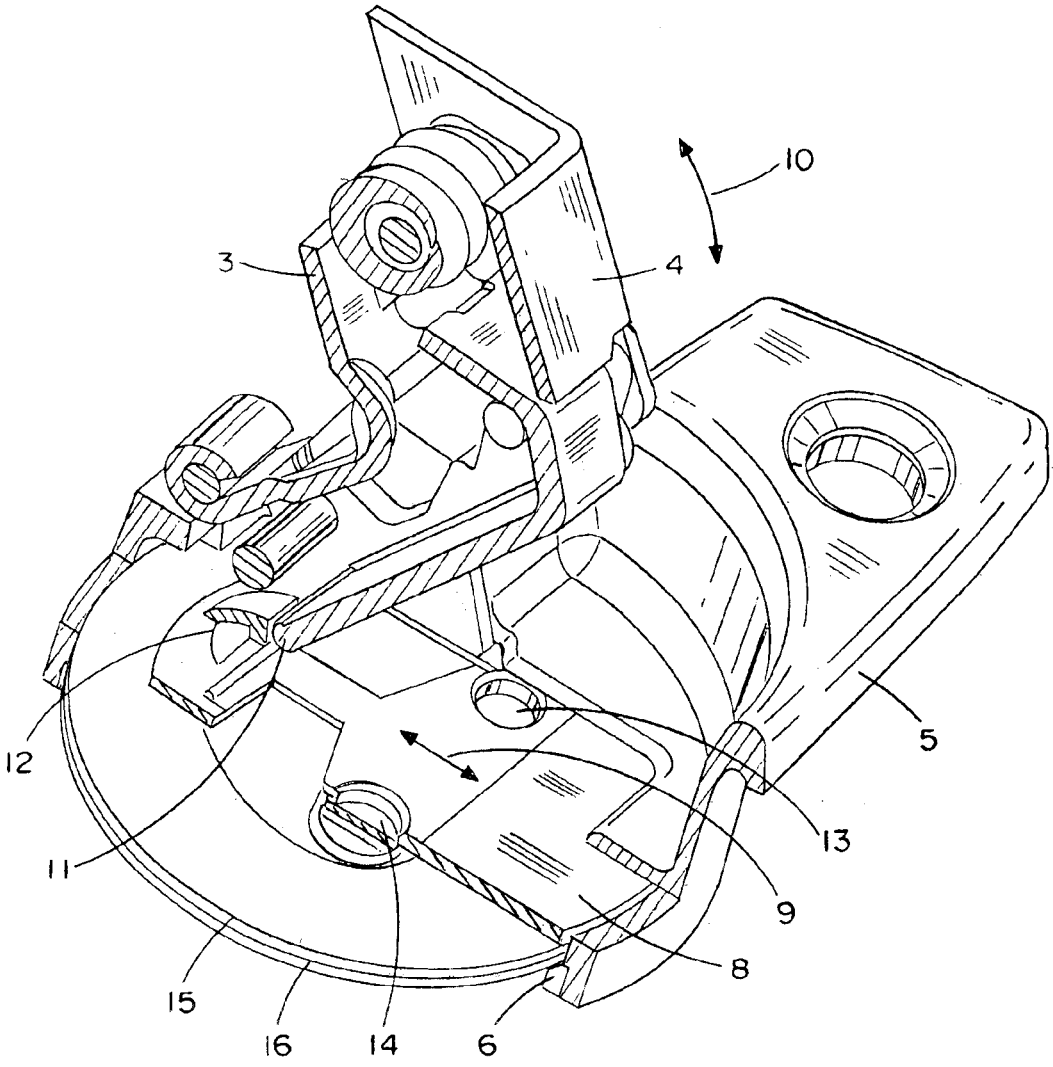
FIG. 3: a partially cut, perspective view of the cabinet hinge.

As shown in FIG. 3, there is a driver plate (8) in the cup base area, which is held linearly movable in arrow direction (9). The moving or shifting results from the articulated hinge's (3,4) movement in arrow direction (10), so that a link edge (11) of the inner articulated lever (4) activates a driver nose (12) of the driver plate (8). Underneath the driver plate (8) there are two, preferably circular, brake plates (15,16), into which a corresponding driver pin (13,14) of the driver plate (8) always engages.

Figure 4:
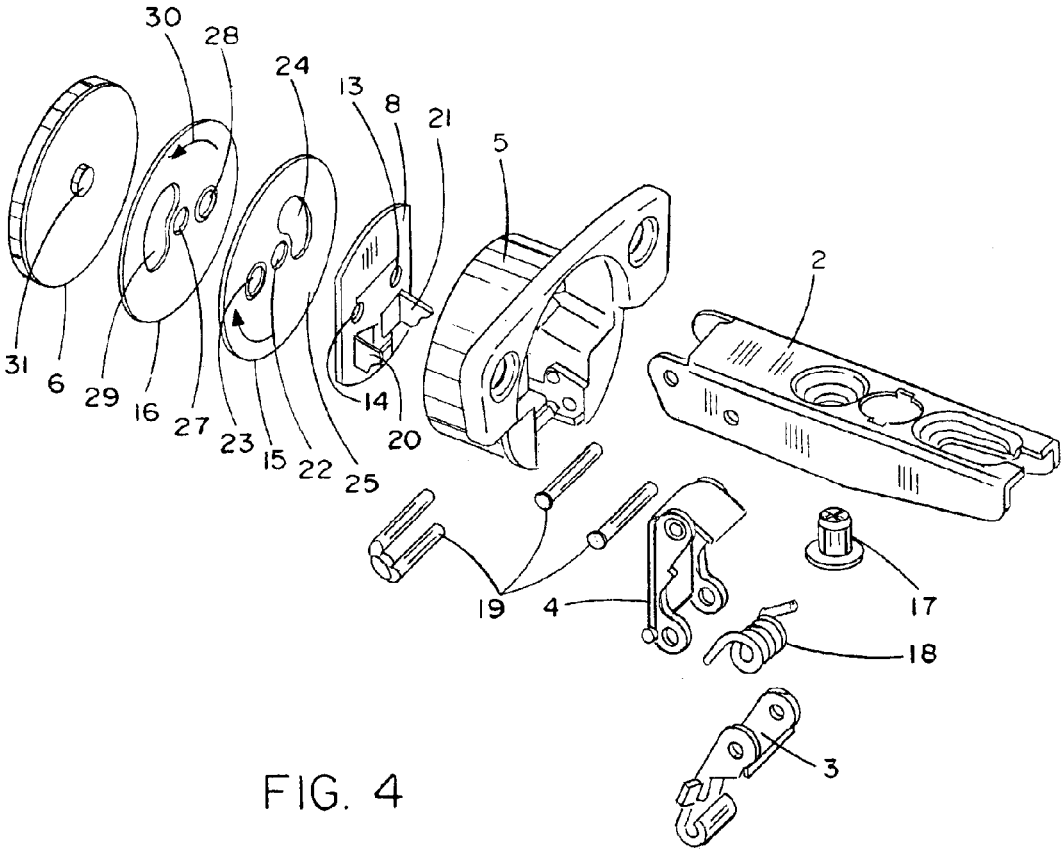
FIG. 4: an exploded representation of the cabinet hinge.

FIG. 4 shows an overview representation of the cabinet hinge (1) with the hinge arm (2) and the hinge cup (5) that are connected together by an articulated lever (3,4), a link spring (18) and a bearing pin (19). A driver pin (14) of the driver plate (8) engages in a corresponding driver opening (23) of the upper brake plate (15). The other driver pin (13) engages by a release (24) of the upper brake plate (15) into a driver opening (28) of the lower brake plate (16). The release (24) is designed as a slotted hole, so that movement of a brake plate (15) is not obstructed by the other brake plate (16) and vice versa. The two brake plates (15,16) are held swiveling by centric bore holes (22,27) on the bearing pin (31) of the base plate (6). The base plate (6) is, for example, screwed in by an outer thread in the hinge cup (5).

Based on the fact that the brake plates (15, 16) rotate, which is caused by the linear movement of the driver plate (8), the driver openings (23, 28) of the brake plates (15, 16) have a certain play or clearance, in order to avoid a wedging or sticking of the driver pins (13, 14) in the driver openings (23, 28).

Figure 5:
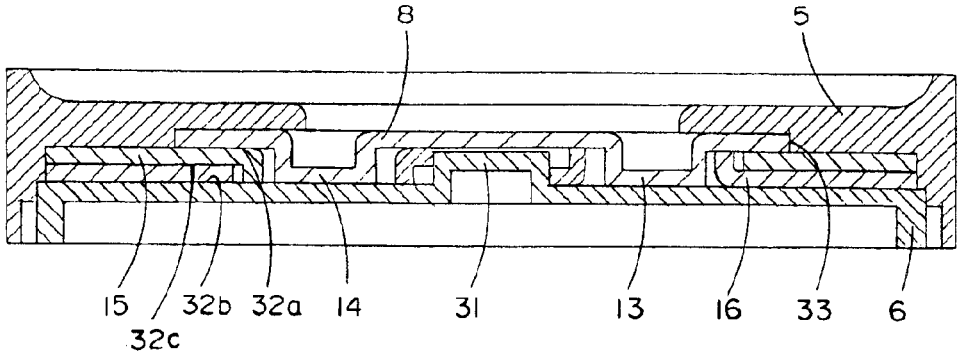
FIG. 5: a section cut through the braking and damping device in the hinge cup.
Figure 6:
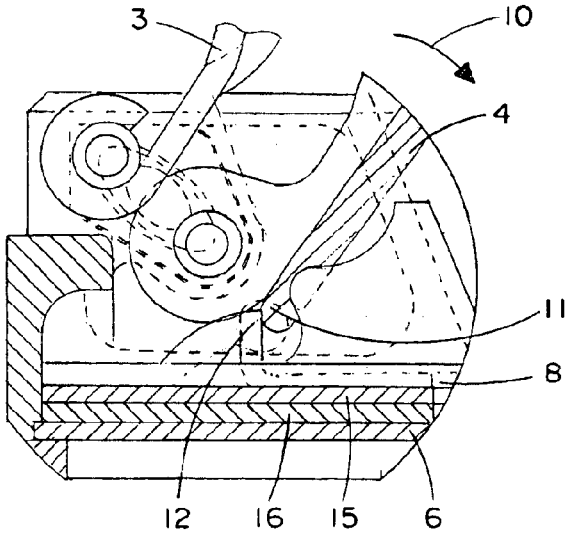
FIG. 6: a detailed view of the driver plate's operation by the articulated lever when the hinge is being closed.
Figure 9:
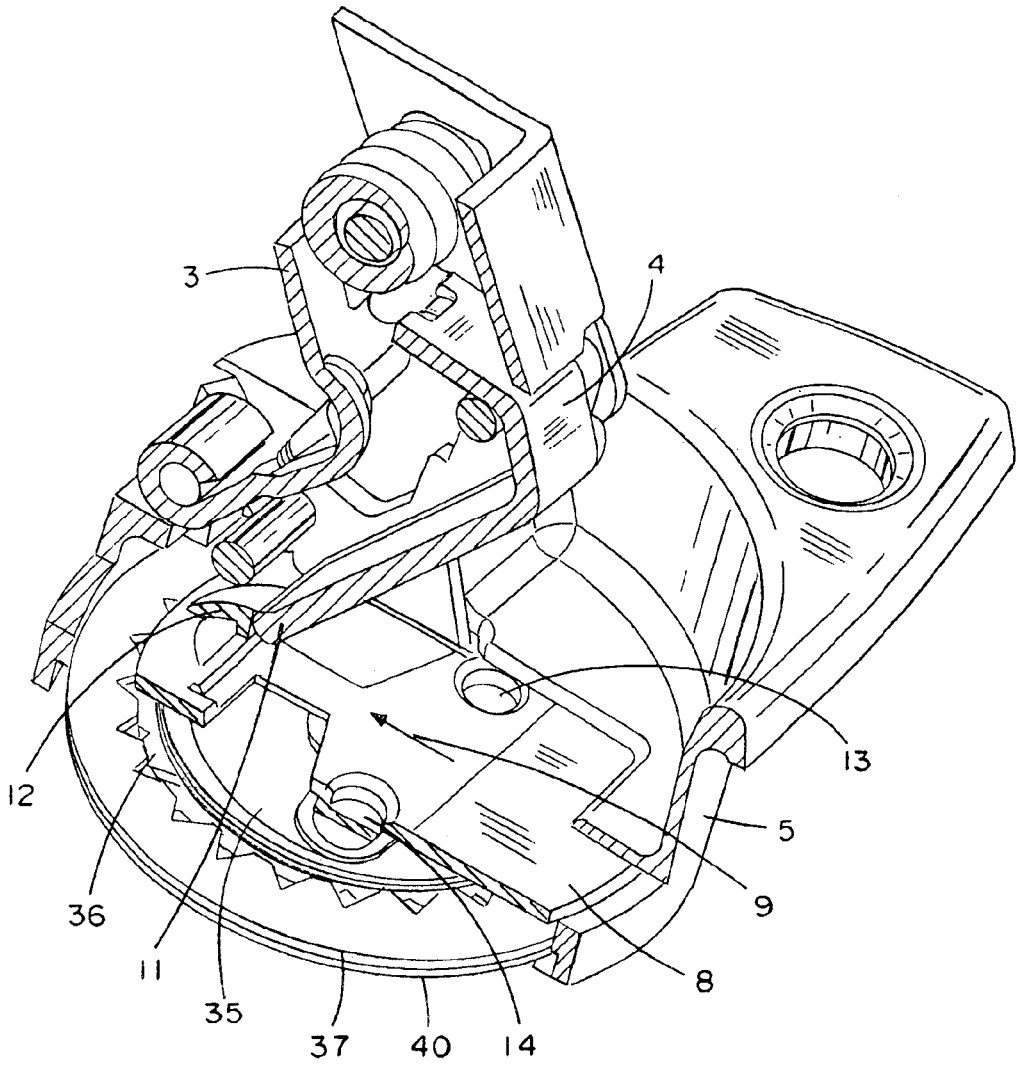
FIG. 9: a partially cut, perspective view of the cabinet hinge in a second embodiment.
Figure 10:
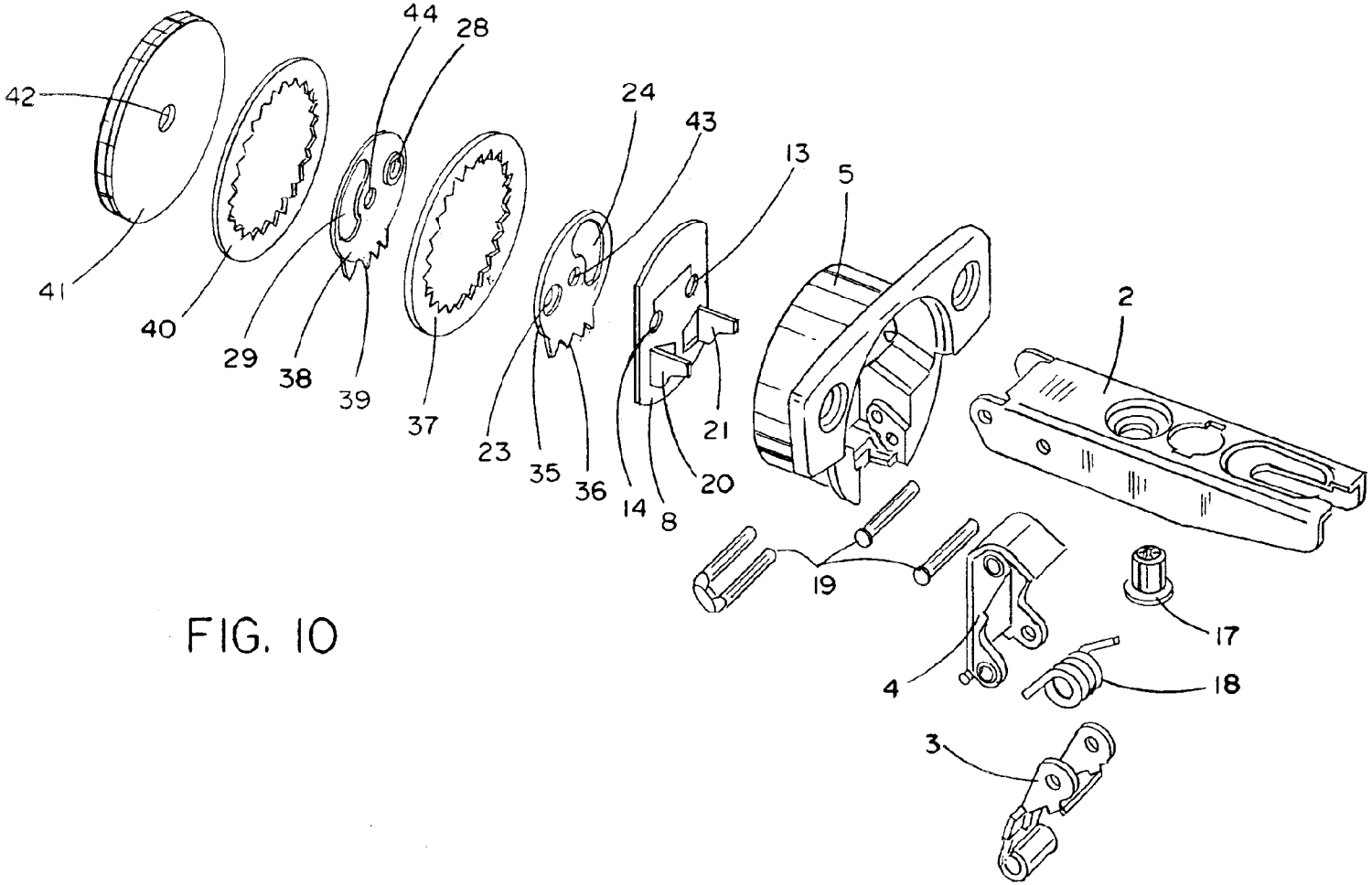
FIG. 10: an exploded representation of the cabinet hinge, according to FIG. 9.
Figure 11:
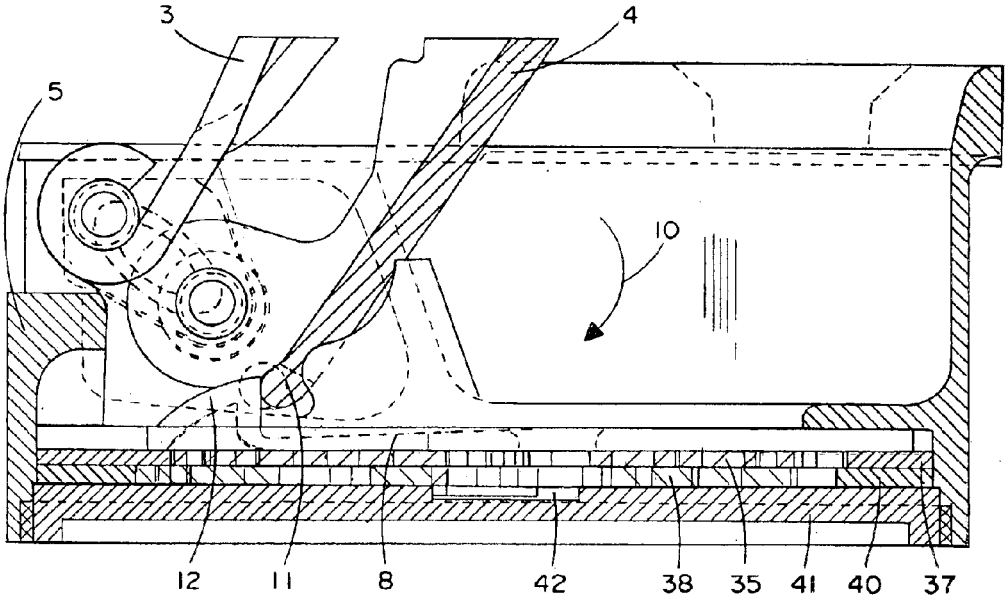
FIG. 11: a detailed view of the driver plate's operation by the articulated lever when the hinge is being closed, according to FIG. 9.
Figure 12:
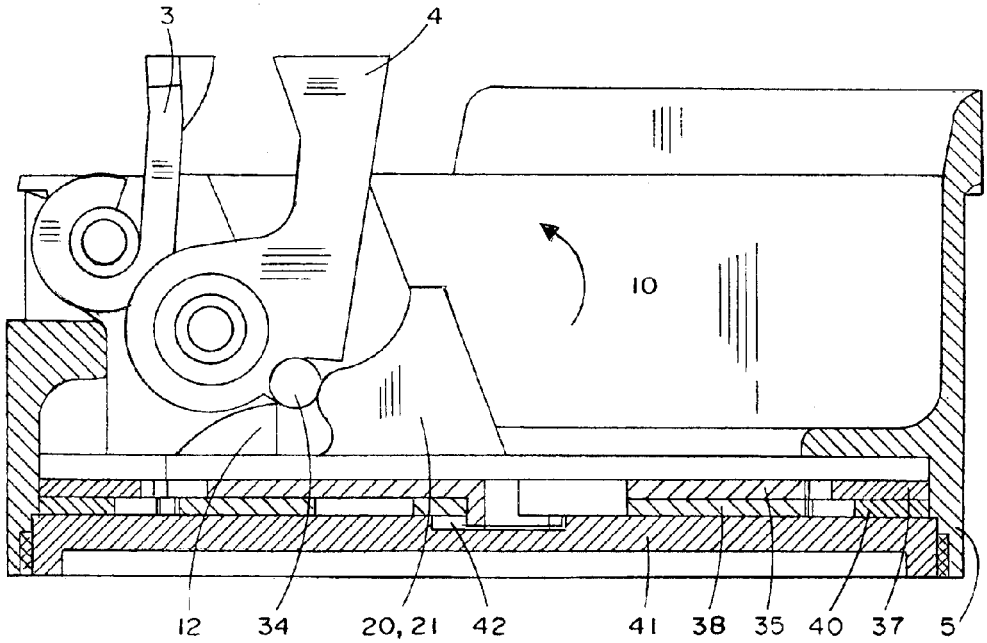
FIG. 12: a detailed view of the driver plate's operation by the articulated lever when the hinge is being opened, according to FIG. 9.

The layer-like structure of the braking device is shown very well in FIG. 5. The device's course of movement is shown in FIGS. 6 to 8.

The articulated lever's (4) rotating motion in arrow direction (10) in the cabinet hinge causes a link edge (11) to meet on a driver nose (12) of the driver plate (8) and moves these linear in arrow direction (9) in a guide groove (33) of the hinge cup (5). This linear movement of the driver plate (8) causes the eccentrically linked brake plates (15, 16) to shift into a rotating motion. Because of the nesting of the linked brake plates (15, 16), two or more brake plates can be moved at the same time. If several brake plates (15, 16) are used, these turn against each other, so that the relative velocity between the swiveling held brake plates (15, 16) is doubled. The braking action is achieved by the friction between the brake surface (32*a*) of the driver plate (8), the brake surface (32*b*) between the brake plates (15, 16) and the brake surface (32*c*) between brake plate (16) and the base plate (6).

The closed end position of the cabinet hinge (1) is shown in FIG. 7. When the hinge (1) is opened in arrow direction (10), a release pin (34) on the articulated lever (4) engages corresponding tabs (20, 21) of the driver plate and move these back in arrow direction (9) until the release pins (34) disengage with the tabs (20, 21) due to the turning motion of the articulated lever (4) and the hinge can be opened with braking action, as shown in FIG. 8.

FIGS. 9 to 12 show a cabinet hinge (1) with a modified design of the braking and damping device (7). The structure and the function mode are similar to the first embodiment.

The design of the brake plates (35, 38) and the additional use of brake gear rims (37, 40), that always surround the corresponding brake plates (35, 38), are substantially different from the first embodiment. The diameter of the brake plates (35, 38) is smaller than the inside diameter of the hinge cup (5). Besides the additional driver openings (23, 28) and releases (24, 29) described above, the brake plates (35, 38) have centric bearing pins, which are held swiveling in a bearing bore hole (42) of the base plate (41). Furthermore, the brake plates (35, 38) have on their outer circumference to some extent teeth (36, 39) that work together with the respective internal teeth of the corresponding brake gear rims (37, 40). The driver pin (14) of the driver plate (8) engages in the driver opening (23) of the upper brake plate (35) and then moves the outer teeth (36) of the upper brake plate (35) into engagement with the inner teeth of the upper brake gear rim (37). The opposite driver pin (13) engages by the release (24) into the driver opening (28) of the lower brake plate (38) and moves the outer teeth (39) of the lower brake plate (38) into engagement with the inner teeth of the lower brake gear rim (40). In this phase of the movement, the brake plate (35, 38) is shifted linear from the driver plate (8) a short distance until the teeth (36, 39) of the brake plates (35, 38) are engaged with the corresponding brake gear rims (37, 40).

When the teeth are engaged with one another, the linear shift of the brake plates (35, 38) is blocked and the brake plates (35, 38) and the respective brake gear rims (37, 40) turn against each other. The brake plates (35, 38) are led with their bearing pins (43, 44) into the bearing bore hole (42), which is designed as a slotted hole, of the base plate. Thus, a free-run between the teethed brake plates (35, 38) results. The braking or damping action can be strengthened, preferably, because these brake components can be placed in a silicone oil or other similarly high viscous medium.

When the cabinet hinge is opened, the teeth disengage with each other. The brake plates (35, 38) and the gear rims (37, 40) no longer rotate. The cabinet hinge can be opened without brakes. So the driver plate (8) is then pushed back and the brake plate (35, 38) turns into the initial "exit" position, so that the driver plate (8) of the brake plate (35, 38) is brought into a linear backward movement in the initial "exit" positions and brings it out of the "teeth," with the brake gear rims (37, 40). Because of the backward stops of the bearing pins (43, 44) in the slotted-bearing bore hole (42), the brake plates (43, 44) are then rotated into the initial "exit" position.

The operation of the braking and damping device by the articulated lever (4) takes place in the same way as described above. This is again shown individually in FIGS. 11 and 12.

DRAWING LEGEND

1 Cabinet hinge
2 Hinge arm
3 Outer articulated lever
4 Inner articulated lever
5 Hinge cup
6 Base plate
7 Braking and damping device
8 Driver plate
9 Arrow direction
10 Arrow direction
11 Link edge
12 Driver nose
13 Driver pin
14 Driver pin
15 Brake plate (upper)
16 Brake plate (lower)
17 Adjusting screw
18 Link spring
19 Link pin
20 Tab
21 Tab
22 Bore hole
23 Driver opening
24 Release
25 Direction of rotation
26 Angle
27 Bore hole
28 Driver opening
29 Release
30 Direction of rotation
31 Bearing pin
32 Brake surface
33 Guide groove
34 Release pin
35 Brake plate (upper)
36 Teeth
37 Brake gear rim (upper)
38 Brake plate (lower)
39 Teeth
40 Brake gear rim (lower)
41 Base plate
42 Bearing bore hole
43 Bearing pin
44 Bearing pin

What is claimed is:

1. Cabinet fitting with integrated braking and damping device comprising:

a hinge arm fastenable on a cabinet component;

a hinge cup fastenable on another, movable cabinet component and connected by at least one articulated lever with the hinge arm:

a driver plate slideably held in the hinge cup and operable by the articulated lever at least one brake plate held in the hinge cup that is rotatable in response to sliding of the driver plate and having at least one brake surface that glides on at least one of an opposing first fixed brake surface in the hinge cup and a second movable brake surface in the hinge cup.

2. Cabinet fitting, according to claim 1, wherein the driver plate is located in a surface area of the hinge cup and is transversely movable in the surface area of the hinge cup.

3. Cabinet fitting, according to claim 2, wherein a base plate is fastened in a bottom area of the hinge cup and has an inner surface that forms the fixed brake surface.

4. Cabinet fitting, according to claim 3, wherein the at least one brake plate is held rotatable on the base plate.

5. Cabinet fitting, according to claim 4, wherein the at least one brake plate is disposed between the base plate and the driver plate.

6. Cabinet fitting, according to claim 5, wherein the driver plate has at least one driver pin that engages in a driver opening of the at least one brake plate disposed eccentrically relative to an axis of rotation of the at least one brake plate.

7. Cabinet fitting, according to claim 6, wherein the movable brake surface is formed by a second brake plate held rotatable in the hinge cup.

8. Cabinet fitting, according to claim 7, wherein the at least one brake plate and the second brake plate lie proximate one another.

9. Cabinet fitting, according to claim 8, wherein the driver plate has a second driver pin that engages in a driver opening of the second brake plate so that the driver pin of the driver plate and the respective driver openings of both brake plates are placed in such a way around the rotation axes of the brake plate so that a movement of the driver plate shifts the brake plates in opposite rotations.

10. Cabinet fitting, according to claim 9, wherein activation of the driver plate by the articulated lever takes place only in an area of a defined closing angle of the hinge arm relative to the hinge cup.

11. Cabinet fitting, according to claim 1, wherein the at least one brake plate is substantially disk shaped with an outside diameter of the at least one brake plate that substantially corresponds to an inside diameter of the hinge cup.

12. Cabinet fitting, according to claim 1, wherein the at least one brake plate is substantially disk shaped with an outside diameter of the at least one brake plate that is substantially smaller than an inside diameter of the hinge cup, and wherein the at least one brake plate is surrounded by a brake gear rim and is partly provided with external teeth, which mesh with internal teeth of the brake gear rim; whereby, the brake gear rim is shifted together in rotation with the at least one brake plate.

13. Cabinet fitting, according to claim 12, wherein the brake gear rim has surface portions that form additional movable brake surfaces.

14. Cabinet fitting, according to claim 13, wherein a highly viscous liquid medium is brought in between the brake surfaces.

* * * * *